United States Patent [19]

Hesketh et al.

[11] Patent Number: 5,065,074

[45] Date of Patent: Nov. 12, 1991

[54] FLUORESCENT TUBE DRIVER AND LIGHTING SYSTEM

[75] Inventors: John Hesketh; Martin Thornton, both of Wakefield, England

[73] Assignee: Coolite Limited, Croydon, United Kingdom

[21] Appl. No.: 669,014

[22] Filed: Mar. 13, 1991

[30] Foreign Application Priority Data

| | | | |
|---|---|---|---|
| Aug. 24, 1990 | [GB] | United Kingdom | 9018695 |
| Nov. 7, 1990 | [GB] | United Kingdom | 9024212 |
| Jan. 4, 1991 | [GB] | United Kingdom | 9100182 |

[51] Int. Cl.[5] ..... H05B 41/36

[52] U.S. Cl. ..... 315/209 R; 315/219; 315/DIG. 2; 315/DIG. 7

[58] Field of Search ..... 315/209 R, 219, 307, 315/221, 224, DIG. 2, DIG. 5, DIG. 7, 223, 225, 276; 331/113 A

[56] References Cited

U.S. PATENT DOCUMENTS 4,005,335 1/1977 Perper ..... 315/224

FOREIGN PATENT DOCUMENTS

WO8503835 8/1985 PCT Int'l Appl. .
1010208 5/1963 United Kingdom .
1308578 6/1971 United Kingdom .
2126810 3/1984 United Kingdom .

*Primary Examiner*—Eugene R. LaRoche
*Assistant Examiner*—Ali Neyzari
*Attorney, Agent, or Firm*—Hoffman, Wasson & Gitler

[57] ABSTRACT

The invention relates to a low voltage, high frequency driver circuit for a fluorescent tube which has high efficiency and low heat output, the invention provides a fluorescent tube driver having first positive and second nominally zero input terminals arranged to be supplied by a low voltage dc source comprising an oscillator circuit consisting of a current source effectively connected through a first capacitor to the second input, a transformer having first and second windings and a transistor, the base of the transistor being connected through the first winding to the junction of the current source and the first capacitor, the collector of the transistor being connected through the second winding to the first input and the emitter of the transistor being connected to the second input, the current source being adjustable such that the power output is in the range 18 to 40 watts, and output means comprising a third winding on the transformer, the third winding having a greater number of turns than the first and second windings and connection points on the third winding for connection to a fluorescent tube, in which the value of the first capacitor is selected so that the frequency of oscillation is in the range 45 to 100 KHz and the transformer and current supply are arranged such that the oscillator operates in switched mode. The second and first windings of the transformer have a ratio of 1.8 to 2.2:1 (preferably 2:1) and the transformer has a ferous material core.

12 Claims, 2 Drawing Sheets

12
13
14
15
16
120
120
120
120
121
124
125
126
127
128
129
130
131
132
132
133
134
C5
C6
C7
C12
C13
C14
C21
D1
D2
D3
D4
D5
D6
R5
R6
R7
R8
R9
R10
R11
R12
R13
R14
R21
R31
P1
Q1
Q2
Q3
Q4
U1
Z1
TH1

FLUORESCENT TUBE DRIVER AND LIGHTING SYSTEM

BACKGROUND OF THE INVENTION

This invention relates to a fluorescent tube driver and a fluorescent lighting system including such a driver.

Conventionally, fluorescent tubes are powered from an alternating mains supply at a relatively high voltage (240 volts nominal in the U.K.) and at a mains frequency which is relatively low (50 hertz in U.K). A conventional fluorescent lighting tube powered from the mains will consume a not insignificant amount of energy and will generate considerable heat; up to 40% of the energy being wasted due to the requirement of the ballast unit to provide a stable supply to the lamp and this energy being dissipated as heat. Because the ballast unit absorbs energy, the energy drawn from the supply is greater than the rated energy of the tube. There are many situations where this heat generation is unacceptable, for example for lighting the shelves of a retail outlet where the goods displayed will react adversely to heat.

PRIOR ART

An object of the invention is to provide a fluorescent tube driver which enables a fluorescent tube lighting system to consume less energy and generate less heat.

Driving systems are known which work from a low voltage supply with an oscillator circuit producing a relatively high frequency oscillation (15 to 35 KHz) and including a transistor and transformer for example as described in UK Patent Specifications 1010208, 1308578 and 2126810 and WO 85/03835. While such systems operate more efficiently than systems working from a mains frequency and generate less heat and may be adequately reliable when working in an unconfined space, such as for driving a ceiling light, we have found that when the circuitry and light are in a confined space, for example for undershelf lighting or in a refrigerator unit, heat dispersion is a problem and failure may result due to overheating. This is because the mode of operation of the oscillator transistor is "linear mode" with the transister collector voltage containing voltages other than supply or zero, for example a sine wave.

SUMMARY OF THE INVENTION

A further object of this invention is to provide a drive system which runs reliably even in a confined space and without generating excessive heat.

We have found that the reliability of such a system can be achieved by a driver which, according to the broadest aspect of the invention, operates in the frequency range 45 to 100 KHz (preferably 45 to 90 KHz) and strictly in so called "switched mode" with the voltage applied to the oscillator transistor being of square wave form.

In one aspect the invention provides a fluorescent tube driver having first positive and second nominally zero input terminals arranged to be supplied by a low voltage dc source (less than 50 volts and preferably 24 volts nominal) comprising an oscillator circuit consisting of a current source effectively connected through a first capacitor to the second input, a transformer having first and second windings and a transistor, the base of the transistor being connected through the first winding to the junction of the current source and the first capacitor, the collector of the transistor being effectively connected through the second winding to the first input and the emitter of the transistor being effectively connected to the second input, the selected current delivery by the current source being such that the power output is in the range 18 to 40 watts, and output means comprising a third winding on the transformer, the third winding having a greater number of turns than the first and second windings and connection points on the third winding for connection to a fluorescent tube, characterised in that the value of the first capacitor is selected so that the frequency of oscillation is in the range 50 to 100 KHz and the transformer and current supply are arranged such that the oscillator operates in switched mode.

Such a system, as in the described embodiment, will run reliably, in a confined space, whilst only raising the surrounding temperature to 3 to 5 degrees C. above ambient.

In a preferred form the switched mode operation is achieved by making the second and first windings of the transformer have a ratio of 1.8 to 2.2:1 (preferably 2:1) and a ferrous material core optimised for operation in the 50 to 100 KHz range, for example a Philips Grade 3H1 ferrite core.(Phillips 4322-021-34730)

Conventionally a different driver circuit is used for each differently rated tube. In a preferred form or another aspect, this invention provides a driver including an adjustable energy input from the low voltage supply to the oscillator circuit so that the same circuit can be used to drive tubes in the rated range 18 to 40 watts.

This has the advantage that only one driver has to be manufactured for use with all such tubes. Additionally we have found that the efficiency of the circuit depends on the drive energy being exactly matched to the particular tube. Even tubes nominally rated the same from a power point of view, but of differing design in practice, have different characteristics; if the power supplied to the tube is not optimized for that tube then more of the energy is dissipated as heat rather than generating light. Accordingly with an adjustable energy input supply, the power input can be exactly matched with the particular tube to provide maximum efficiency.

The current source preferably comprises a resistor and a potentiometer effectively connected across the input terminals, a current generating transistor (a pnp power transistor), having its base connected to a take-off of the potentiometer and its emitter/collector connected between a resistor (connected effectively to the supply) and the first capacitor, and the first transformer winding being connected to the junction of the first capacitor and the collector of the current generating transistor.

The current source is arranged to provide a guaranteed saturation drive current (as opposed to a drive causing biasing into linear operation) to the transistor of the oscillator, for example, in the circuit of the preferred embodiment, the current supplied to the transistor oscillator will vary from a minimum of 18 mA (typically 20 mA for an 18 watt tube) to a maximum of 95 mA. The required value will be dependent on tube power.

With advantage the driver includes a pair of capacitors connected in parallel between the dc input terminals (upstream of the oscillator circuit) with values chosen to act as high frequency rail suppression and medium frequency rail suppression components to ensure minimal high frequency ripple is induced into the dc supply line of the oscillator.

The driver preferably includes an open circuit protection circuit arranged to monitor the voltage at the collector of the oscillator transistor so as to de-energize the current generating circuit if an open circuit condition occurs. This avoids damage if the tube fails or is disconnected. Preferably the open circuit protection circuit can only be reset by the removal of the voltage source for a predetermined period, for example two seconds, followed by re-energization of the circuit.

The driver may include an active tube striking circuit arranged to increase the setting of the current generating circuit on initial switch-on to deliver an initially increased (+50%) output power for about one second so as to ensure reliable tube striking. The striking voltage will vary depending upon tube power and style but will be in the range 300 to 1100 V.

The invention extends to a fluorescent tube lighting system driven by such a driver.

BRIEF DESCRIPTION OF THE DRAWINGS

One embodiment of fluorescent tube driver circuit and a lighting system including such a circuit will now be described, by way of example only, with reference to the accompanying drawings of which.

DETAILED DESCRIPTION OF ONE EMBODIMENT

Figure 1:
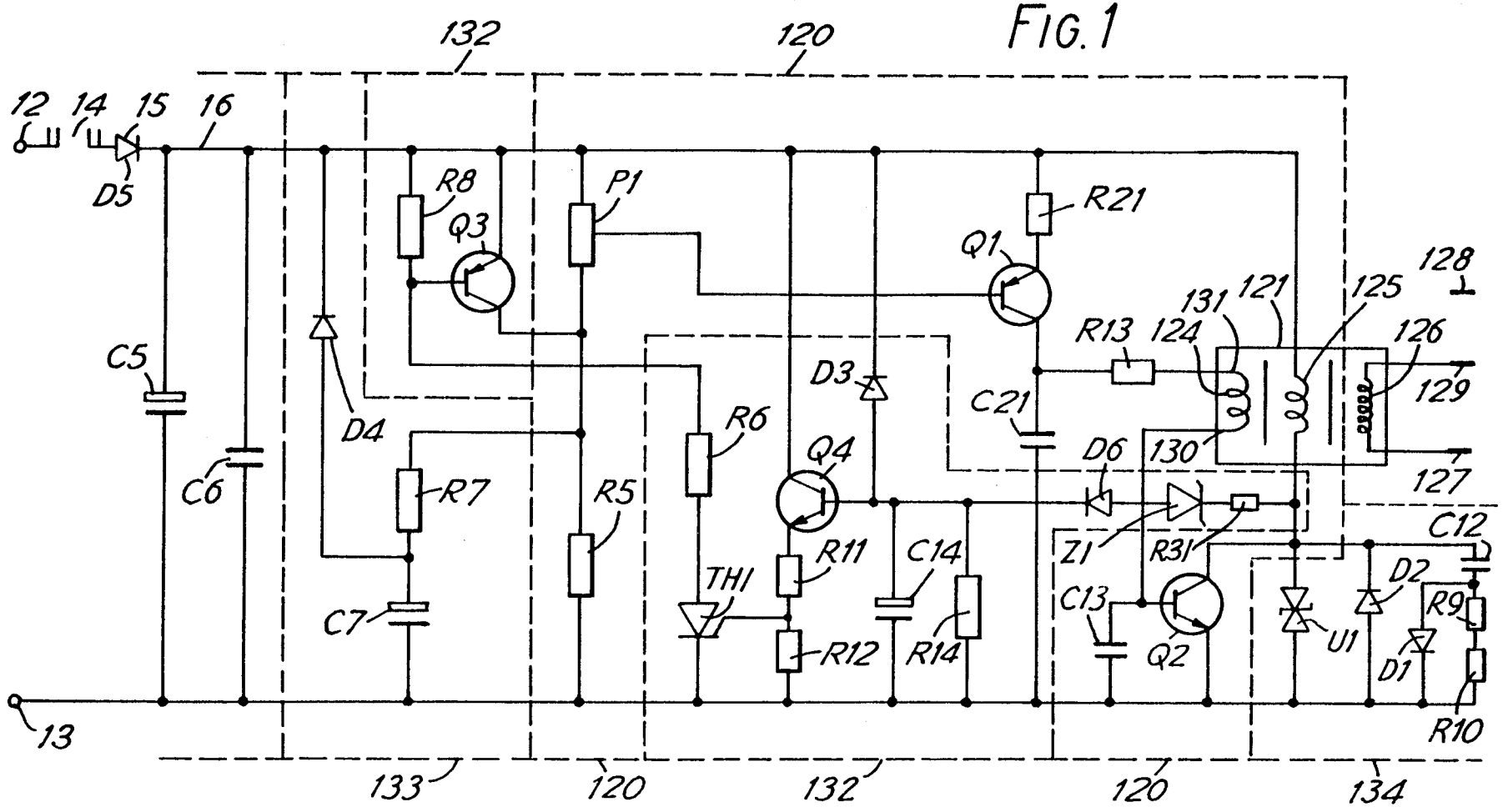
FIG. 1 is a circuit diagram of the driver circuit.

The driver circuit of FIG. 1 has positive and nominally zero input terminals 12, 13 indicated as +24 volts and 0 volts respectively for connection to a 24 volt nominal DC supply (in practice 24.5 to 29 volts). This system could alternatively be designed to run on 12 volts or some other low voltage. The positive terminal 12 is connected through a single use replaceable fuse 14 of 1.6 amps and a diode 15 (IN 5402) to a positive power supply line 16.

An oscillator circuit 120 is connected between the power supply line 16 and the zero terminal 13 and comprises a transformer 121, a main switching transistor Q2 a capacitor C13, and a capacitor C21. The oscillator circuit 120 further comprises a current generating circuit comprising transistor Q1, resistor R5, potentiometer P1 and resistor R21.

A pair of capacitors C5 and C6 are connected in parallel between the power supply 16 and the zero terminal 13, at a position between the oscillator circuit 120 and the input terminal 13. C5 is an electrolytic component (470 F) and is designed to locally supply high transient current demand to the oscillator circuit. C5, however, does possess quite a high impedance at high frequency and is not capable of high frequency rail decoupling. It achieves medium frequency rail decoupling. C6 is a ceramic capacitor (100 NF) and provides the required degree of high frequency decoupling.

Considering the oscillator circuit in more detail, resistor R21 has one side connected to the power supply line 16 and the other side connected to the emitter of transistor Q1, whose collector is connected through capacitor C21 to the terminal 13. The transformer 121 has a first winding 124, a second winding 125 and a third output winding 126. The base of transistor Q2 is connected through winding 124 and resistor R13 to the junction of Q1 and C21 and also through a base damping capacitor C13 to the zero input terminal.

The collector of transistor Q2 is connected through the winding 125 to the input line 16 and the emitter of transistor Q2 is connected to the zero input terminal. The output winding 126 has its ends connected to two output terminals 127 and 129 forming the output terminals to supply power to a fluorescent light tube. Another output terminal 128 can be connected to an intermediate point of the output winding to vary the power output. The base of transistor Q1 is connected to a take-off point of the potentiometer P1 one end of which is connected to power supply line 16 and the other end which is connected through resistor R5 to terminal 13.

At switch on, current supplied by the current generator Q1, R21, P1, R5 flows via R13 and transformer winding 124 to the base of switching transistor Q2 and switches on the transistor. This current is at least 18 mA to act as a saturation current. This action causes winding 125 to be energized with the collector of Q2 being the negative terminal. As winding 125 is energized, voltage is induced in winding 124 and as this winding is in opposition to winding 125 this causes a current flow in the opposite direction to the current flow in winding 125. As the end 130 of winding 124 is held at 0.7 volts by the VBE of transistor Q2, the end 131 of the winding attempts to drive negative and in doing this discharges capacitor C21. Eventually, C21 discharges such that when the winding 124 voltage has decreased to zero the C21 voltage is at 0.7 volts. This results in no drive to the base of the transistor and hence the transistor Q2 switches off. During switchoff, a back EMF will be generated in the winding 125 and to allow for this the transistor Q2 is a high voltage device.

Because capacitor C21 has only 0.7 volts across it, a charging current will now be provided by current source R21, Q1, P1, R5 having the effect of re-starting the process by simultaneously re-charging C21 and switching on the transistor Q2 through the winding 124. The whole process thus re-starts. It can be seen that C21 has the effect of determining the frequency of oscillation and in the present example where C21 has the value 33 NF the circuit will oscillate at a frequency of between 50 and 100 KHz.

The ratio of turns in winding 125 to winding 124 is 2:1 and the transformer has a ferrous core giving optimum coupling in the range of 50 to 100 KHz to ensure that the oscillator acts in 'switched mode' with the transistor Q2 either in full saturation or completely off.

A high voltage output is produced in the output winding 126. The alternating current in the winding 125, caused by the switching action of the transistor Q2 is stepped up by the high turns ratio 8.3:1 (at least 5:1) of the winding 126 to the winding 125. A degree of self-regulation is achieved by the use of a step-up transformer with a high compliance output winding characteristic.

The circuit of FIG. 1 includes an over voltage detection and protection circuit/open circuit protection (OCP circuit) 132 consisting of the elements resistor R31, zenor diode Z1, diode D6, resistor R14, capacitor C14, transistor Q4, resistor R11, resistor R12, thyristor TH1, resistor R6, resistor R8 and transistor Q3. One side of resistor R31 is connected to the collector of transistor Q2 and the other side is connected through Z1 and D6 to the base of Q4, the base being in addition connected to the anode of diode D3, and the negative terminal through C14 and R14 in parallel. The emitter of Q4 is connected via R11 and R12 in series to the negative terminal and the collector of Q4 is connected to the supply line 16. The junction of R11 and R12 is connected to a gate terminal of the thyristor TH1, the cathode of which is connected to the negative terminal and the anode terminal is connected through R6 and R8 in series to line 16. The junction of R6 and R8 is connected to the base of Q3 which has its emitter connected to line 16 and its collector connected to the junction of potentiometer P1 and resistor R5.

This OCP circuit continuously monitors the collector voltage of Q2 and ensures that no damage will be caused to the circuit should an open circuit condition be created within the fluorescent lamp or should the lamp be disconnected from the output terminals. This is achieved by the use of an active over voltage detection. Should a fault condition occur which results in generation of excessive output voltage, then the aforementioned detection circuit will be biased into action resulting in operation of TH1 which in turn latches switching on Q3 thus de-energising the current generator R5, P1, Q1 and R21. This results in the removal of any output drive. This latching protective action is arranged so that it can only be reset by the removal of the input DC voltage source for a predetermined period followed by re-energisation of the circuit.

The circuit of FIG. 1 additionally includes an active striking circuit 133 comprising the components diode D4, capacitor C7 and resistor R7. When the power is switched on, this circuit acts to modify the setting of the current generator circuit R5, P1, Q1 and R21 to a current delivery value of approximately 1.6 times normal operating current which is necessary to increase output drive and thus ensure reliable tube striking. After a predetermined period (determined by the values of R7 and C7) the active striker circuit charges and is effectively open circuit thus allowing the current generator R5, P1, Q1 and R21 to assume normal operation.

The circuit of FIG. 1 additionally includes a circuit 134 for snubbing/absorbing peak transient voltages present on the collector of Q2. This circuit includes the components transient clipper U1, diode D2, diode D1, capacitor C12, resistor R9 and resistor R10 and acts to prevent damage to transistor Q2 which might occur through excessive collector voltages. In this circuit, U1 and D2 are connected in parallel between the collector of Q2 and the zero terminal 13, C12 has one side connected to the collector of Q2 and the other side connected to terminal 13 through D1 in parallel with R9 and R10 in series.

Figure 2:
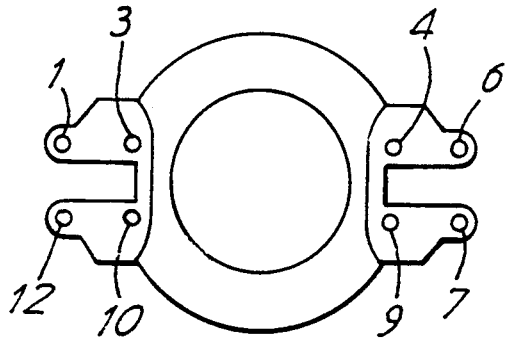
FIG. 2 is a diagramatic view of the transformer forming part of the driver circuit with the windings not illustrated.

FIG. 2 shows the transformer bobbin for forming the transformer 121 and having a ferrous core 121A as described. The windings are not shown but are all wound in the same direction and comprise the following:

the inner (output) winding 126 starts at pin 10 and comprises 250 turns of 0.19 millimeter insulated enamelled wire finishing at pin 1.

the next (first) winding 124 starts at pin 9 and comprises 15 turns of 0.19 millimeter insulated enamelled wire finishing at pin 4.

the next (second) winding 125 starts at pin 7 and comprises 30 turns of 0.375 millimeter insulated enamelled wire finishing at pin 6. Insulating tape is used between each winding.

The circuit with transformer as described provide a driver in which the lumen output of the lamp is controlled, enabling the lamp to operate at a reduced DC power consumption from its recommended rated consumption resulting in an energy saving up to 40% compared with conventional operation.

The OCP circuit ensures that no damage will be caused to the circuit should an open circuit condition be created. It prevents arcing which could result across the transformer output terminals under no load conditions.

The power delivered to the tube may be determined by means of the programmable current source R5, P1, Q1 and R1 The driver circuit includes the active switch element transistor Q2 which is driven in switched mode resulting in maximum operating efficiency and thus minimal heat dissipation compared with a sine wave oscillator solution which would result in high levels of dissipation. The frequency of operation is determined by the single component C21.

The active striking circuit D4, R7, C7 ensures active striking at startup.

The peak transient voltage absorption circuit connected to the Q2 collector consisting of U1, C12, R9, R10 and D1 serves two purposes, firstly it limits peak back emf spikes generated by winding 125 by absorbing these in the circuit C12, D1, during normal operation and secondly, it serves to protect Q2 from excess voltage during open circuit output conditions prior to the open circuit protection activating. Diode D2 is employed to protect Q2 from reverse polcrity which would arise during ringing of the collector inductive load 125.

In the circuit of FIG. 1 the components have the following values:

C21 33NF, C12 4N7, C13 100 NF, C14 100 F, C5 470 F, C6 100 NF, C7 220 F, R31 15K, R21 47R, R13 zero, R14 47K, R5 8K2, R6 1K8, R7 10K, R8 220R, R9 470R, R10 470R, R11 2K2, R12 1K0, Q1 TIP126, Q2 BD955, Q3 ZTX753, Q4 BC182, TH1 2N5061, D1 BYW95B, D2 BYW95B, D3 IN4001, D4 IN4001, D5 IN5402, D6 IN914, Z1 BZX55 C100, U1 Z15L101

Optionally, the lighting system includes a heat sink to assist dissipation of heat from the driver.

Figure 3:
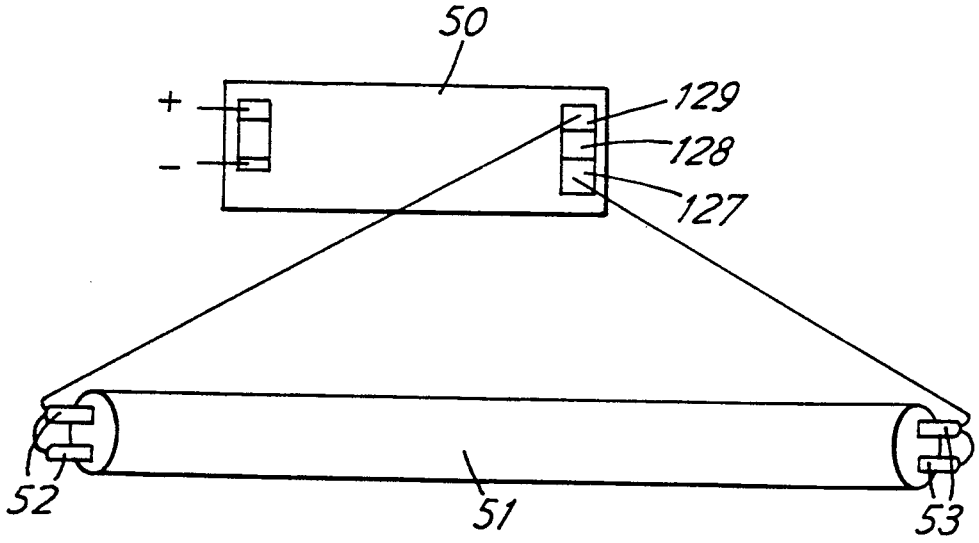
FIG. 3 is a diagramatic view of a lighting system.

FIG. 3 shows diagramatically the driver 50 connected to a hot cathode fluorescent tube 51, with one output terminal 129 of the driver connected to pins 52 and the other output connected to pins 53 at the other end of the tube.

The following table shows comparative figures for the energy consumed by running lamps with a driver according to the invention and with a mains power supply.

| LAMP TYPE SIZE | RATED WATTS PRINTED ON LAMP | MAINS/WATTS ON CIRCUIT | SYSTEM WITH DRIVER:WATTS ON CIRCUIT |
|---|---|---|---|
| 2' 25 mm Bi-Pin | 18 Watts | 25 Watts | 15 Watts |
| 2L 4 Pin | 18 Watts | 25 Watts | 13 Watts |
| 3' 25 mm Bi-Pin | 30 Watts | 42 Watts | 23 Watts |
| 4' 25 mm Bi-Pin | 36 Watts | 50 Watts | 23 Watts |

-continued

| LAMP TYPE SIZE | RATED WATTS PRINTED ON LAMP | MAINS/WATTS ON CIRCUIT | SYSTEM WITH DRIVER:WATTS ON CIRCUIT |
|---|---|---|---|
| 2L 4 Pin | 36 Watts | 50 Watts | 23 Watts |
| 2L 4 Pin | 40 Watts | 56 Watts | 25 Watts |

The figures show that mains fitting has a gear loss power factor of 0.4 which means an extra 40% more energy is required to run the lamp than stated on the actual lamp. With the driver of the invention gear loss is minimal and the figures include for the very slight loss.

What is claimed is:

1. A fluorescent tube driver having first positive and second nominally zero input terminals arranged to be supplied by a low voltage DC source (less than 50 volts) comprising an oscillator circuit consisting of a current source effectively connected through a first capacitor to the second input, a transformer having first and second windings and an oscillator transistor having a base, an emitter and a collector, the base of the oscillator transistor being connected through the first winding to the junction of the current source and the first capacitor, the collector of the oscillator transistor being effectively connected through the second winding to the first input and the emitter of the oscillator transistor being effectively connected to the second input, the current source being arranged to deliver a current such that the power output is in the range 18 to 40 watts, and output means comprising a third winding on the transformer, the third winding having a greater number of turns than the first and second windings, and connection points on the third winding for connection to a fluorescent tube, in which the value of the first capacitor is selected so that the frequency of the oscillator is in the range 50 to 100 KHz and the transformer and current source are arranged such that the oscillator operates in switched mode, the current source being arranged to supply an adjustable current to the oscillator transistor, the current being adjustable to operate tubes in the range 18–40 watts at maximum efficiency.

2. A fluorescent tube driver according to claim 1 in which the second and first windings of the transformer have a ratio of 1.8 to 2.2:1 and the transformer has a ferous material core optimised for operation in the 50 to 100 KHz range.

3. A driver according to claim 2 in which the current source comprises a potentiometer in series with a current source resistor, and a current generating transistor having a base connected to a take-off connection from the potentiometer and having an emitter and collector connected between a further resistor and the first capacitor.

4. A driver according to claim 1 in which the current source is arranged to provide a saturation drive current to the oscillator transistor.

5. A driver according to claim 4 in which the current supplied by the current source to the oscillator transistor is in the range 18 mA to 85 mA.

6. A driver according to claim 1 in which the ratio of the turns of the output winding to the turns of the first and second windings is at least 5:1.

7. A driver according to claim 1 including a pair of capacitors connected in parallel between the dc input terminals (upstream of the oscillator circuit) with values chosen to act as high frequency rail suppression and medium frequency rail suppression components to ensure minimal high frequency ripple is induced into the dc supply line of the oscillator.

8. A driver according to claim 1 including an open circuit protection circuit arranged to monitor the voltage at a collector of the oscillator transistor and to de-energize the current source if an open circuit condition occurs.

9. A driver according to claim 8 including means ensuring that the open circuit protection circuit can only be reset by the removal of the voltage source for a predetermined period followed by re-energization of the circuit.

10. A driver according to claim 1 including an active tube striking circuit which modifies the setting of the current source on initial switch-on to deliver an initially increased output current so as to ensure reliable tube striking.

11. A driver according to claim 10 in which the active striking circuit produces a current substantially 50% greater for a period of substantially one second.

12. A fluorescent tube lighting system including a driver, a fluorescent tube with a rated power output in the range 18 to 40 watts connected to be driven by the driver and a lower voltage DC source connected to the driver by first positive and second nominally zero input terminals of the driver; the driver comprising an oscillator circuit oscillating in the range 50–100 KHz, consisting of a current source effectively connected through a first capacitor to the second input, a transformer having first, second and third windings, and an oscillator transistor having a base, an emitter and a collector, the base being connected through the first winding to a junction of the current source and the first capacitor, the collector of the oscillator transistor being effectively connected through the second winding to the first input and the emitter of the oscillator transistor being effectively connected to the second input, the oscillator operates in switched mode, and the fluorescent tube being connected to connection points on the third winding, which third winding has a greater number of turns than the first and second windings have turns, the current source being arranged to supply an adjustable current to the oscillator transistor, the current being adjustable to operate tubes in the range 18–40 watts at maximum efficiency.

* * * * *